US006288623B1

(12) United States Patent
Janzen

(10) Patent No.: US 6,288,623 B1
(45) Date of Patent: Sep. 11, 2001

(54) HOLDING APPARATUS FOR TRANSPORT OF CONVEYED ITEMS

(75) Inventor: Klaus Janzen, Lünen (DE)

(73) Assignee: Neuhauser, GmbH Co., Lunen (DE)

( * ) Notice: Subject to any disclaimer, the term of this patent is extended or adjusted under 35 U.S.C. 154(b) by 0 days.

(21) Appl. No.: 09/095,783

(22) Filed: Jun. 11, 1998

(30) Foreign Application Priority Data

Jun. 11, 1997 (DE) ..... 197 24 634

(51) Int. Cl.[7] ..... H01F 7/20
(52) U.S. Cl. ..... 335/291; 335/289
(58) Field of Search ..... 335/285, 290, 335/291, 292–4, 295, 300, 306; 269/8

(56) References Cited

U.S. PATENT DOCUMENTS 3,824,516 * 7/1974 Benowitz ..... 335/291
4,075,589 * 2/1978 Braillon ..... 335/286
4,378,548 * 3/1983 Rybak ..... 335/291
4,847,582 * 7/1989 Cardone et al. ..... 335/289

FOREIGN PATENT DOCUMENTS 282878 3/1967 (DE) .
3423482 6/1984 (DE) .

* cited by examiner

*Primary Examiner*—Lincoln Donovan
(74) *Attorney, Agent, or Firm*—Rosenman & Colin, LLP

(57) ABSTRACT

The invention relates to a holding apparatus for the transport of conveyed items, in particular the lifting, transporting, imbricating and stacking of ferromagnetic conveyed parts having at least two permanent magnets for generating a permanent magnetic field, at least two electrical magnet coils for generating a temporary magnetic field and compensation of the permanent magnetic field and a magnetically conductive housing. The permanent magnet is magnetized in the direction of its smallest dimension ($l_3$) and is arranged in the direction of magnetization (M) at the rear with one pole (N, S) against the housing, forming a magnetic yoke, and at the front with the other pole (S, N) in the direction of a working clearance opposite the conveyed parts. The housing in cross section has three or more webs rising up from a baseplate and permanent magnets in each case fastened at the top in the region of the working clearance. In addition, at least two mutually independently energizable magnet coils are provided in at least one interweb space.

15 Claims, 4 Drawing Sheets

HOLDING APPARATUS FOR TRANSPORT OF CONVEYED ITEMS

BACKGROUND OF THE INVENTION

The invention relates to a holding apparatus for the transport of conveyed items, in particular the lifting, transporting, imbricating and stacking of ferromagnetic conveyed parts, having at least one permanent magnet for generating a permanent magnetic field, also at least one electrical magnet coil for generating a temporary magnetic field and compensation of the permanent magnetic field, and having a magnetically conductive housing for the permanent magnet and the magnet coil, the permanent magnet usually being magnetized in the direction of its smallest dimension, the permanent magnet also being arranged in the direction of magnetization at the rear with one pole against the housing, forming a magnetic yoke, and at the front with the other pole in the direction of a working clearance opposite the conveyed parts, and the housing having in cross section two or more webs rising up from a baseplate. For the purposes of the invention, a working clearance is generally to be understood as a clearance of which the width is dimensioned such that a displacement or compensation of the permanent magnetic field by the temporary magnetic field takes place principally at this location. That is to say, all the magnetic field changes to be set for the secure holding and letting go of the conveyed parts are ideally restricted to the region of the working clearance. The webs are of a regular finger-like design in cross section.

A holding apparatus of the type described at the beginning is disclosed by German Patent 34 23 482.

In this case there is provided a single permanent magnet, which is arranged centrally in a magnetically conductive iron yoke. Arranged between this permanent magnet and the working clearance are a magnetically conductive compensation plate with a magnetically conductive web and a magnetically conductive central pole, in this sequence. This is disadvantageous with regard to possible stray fields. This is so since the permanent magnet is not arranged directly in the region of the working clearance but is set back from it. As a consequence, losses in magnetic field strength are unavoidable.

Added to this is that only one electrical coil is provided between the compensation plate and the central pole for the compensation or displacement of the magnetic field out of the region of the working clearance. That is to say, this one coil must be designed such that the permanent magnetic field is reliably compensated. Adaptation to differently designed conveyed parts is not accomplished by this means. It must also be taken into consideration that, due to the necessary design of the electrical coil to suit the maximally occurring adhesive forces between the conveyed part and the holding apparatus, the achievable switching frequency is often adversely influenced. This can be attributed to the fact that coils of adequate magnetic field strength for generating an opposing field have at the same time a great inductance (measured in henries).

According to Lenz's law, however, large inductances (formerly self-inductance coefficients) effect a lessening or slowing of the rise of a switching current, with the result that the switching frequency is reduced. This is to be regarded as disadvantageous in particular in the transport of conveyed items with the required high cycle times.

Austrian Patent 282 878 discloses a load lifting magnet for handling ferromagnetic loads, having a plurality of magnetic poles and excitation windings assigned to the poles, the load lifting magnet having a primary magnetic circuit which has an internal group of first poles and at least one first excitation winding which can be switched on independently. There is also provided an additional magnetic pole, which is magnetically isolated from the primary circuit and to which there is assigned at least one second excitation winding, which can be switched on independently. This is intended overall to provide a load lifting magnet with which it is possible to be certain to lift only the uppermost plate in each case off a stack of single ferromagnetic plates. At the same time, it is intended to be ensured that, during further transport of the lifted-off plate, an adequately great adhesive force can be exerted on the single plate. If need be, it is also to be possible to transport safely relatively large customary ferromagnetic loads. —Problems associated with the achievable switching frequencies are not mentioned. —This is where the invention overall wishes to provide a remedy.

The invention is based on the object of developing a holding apparatus of the embodiment described at the beginning in such a way as to make it possible to adapt to different conveyed parts while retaining at the same time a high switching frequency and simple construction.

SUMMARY OF THE INVENTION

To achieve this object, the invention proposes in the case of a holding apparatus of the generic type that at least one permanent magnet is provided in each web and at least two mutually independently energizable magnet coils are provided in at least one inter-web space. The webs rising up from the baseplate are usually arranged hanging down in the installed state of the holding apparatus, with the result that the permanent magnet or magnets hold or attract the conveyed parts taken past underneath against the action of gravity. A compensation of the permanent magnetic field then causes dropping off of the conveyed parts on account of gravity. At the same time, the direction of magnetization of the permanent magnets is defined such that it is from the north pole (N) in the direction of the south pole (S). Generally, the permanent magnets are arranged in the webs in each case at the bottom, at the top or in a position in between. According to a preferred embodiment, there may be provided 3, 5, 7, 9, . . . webs, i.e. (2n+1) webs, or 2, 3, 4 . . . , i.e. (n+1) webs, where n=1, 2, 3, . . . , with permanent magnets in each case, the webs being arranged in cross section lying respectively opposite one another in pairs in comparison with a central middle web. Moreover, the permanent magnets fastened in the longitudinal extent of the webs generally have—starting from the middle web—respectively alternating directions of magnetization, with the result that the webs lying opposite one another in pairs in comparison with the middle web in each case have permanent magnets with the same direction of magnetization. The webs generally rise up perpendicularly from the baseplate, the permanent magnets being fastened in perpendicular prolongation of the webs such that their respective direction of magnetization coincides with the direction of the extent of the web. Consequently, the direction of magnetization and the baseplate are arranged perpendicularly with respect to each other.

A particularly simple design from a production engineering viewpoint is obtained in the case where the webs are arranged equidistantly in comparison with the middle web and enclose between them equally sized inter-web spaces. The topology of the holding apparatus is chosen principally such that the baseplate is of a circular design and the webs are arranged concentrically with respect to the cylindrical middle web, forming a rotationally symmetrical holding pot with inter-web spaces in the form of annular channels. As an alternative to this, there is also the possibility of making the baseplate of a rectangular design and arranging the webs mirror-symmetrically in the longitudinal direction with respect to the I-shaped middle web, forming a cuboidal holding bar with interweb spaces in the manner of longitudinal channels. This holding bar can be adapted without any problem to, for example, metal plates to be transported.

The measures of the invention described above not only make possible a simple construction but also allow different conveyed parts to be lifted, transported and stacked with at the same time a high switching frequency. This is attributable on the one hand to the fact that the adhesive force required for securely holding the conveyed parts is applied by the permanent magnets arranged in the longitudinal extent of the webs. There are no longer any stray losses through interposed webs, compensation plates or central poles, as required according to the prior art. Rather, the permanent magnets are positioned exactly where the adhesive force is introduced. As a consequence of this, on the other hand, it is possible in principle to work with magnet coils of smaller dimensions. This is so since any stray losses of the permanent magnets are minimized. In a corresponding way, for the same adhesive force, less magnetic material is required for the permanent magnets, or the same amount of magnetic material as in the case of the prior art results in a greater adhesive force.

Moreover, the exposed position of the permanent magnets in the finger-like webs allows compensating to be less complicated, with the result that a further reduced configuration of the magnet coils is possible with regard to the magnetic field strength achievable with them.

This has the overall effect that at the same time unavoidable self-induction effects in the magnet coils no longer have such an impact. This has a positive effect on achievable switching frequencies. The general procedure here is that the two magnet coils are arranged in cross section in the direction of the extent of the webs with their turns one behind the other or one above the other, the respective turns enclosing the middle web concentrically in the manner of circles, ellipses, rounded-off rectangles or the like. Generally, the two magnet coils are arranged rising up from the base plate and have a combined overall height which corresponds substantially to the lengths of the webs. The temporary magnetic fields generated by the two magnet coils are principally modeled on the field of a bar magnet with—in comparison with the direction of magnetization of the permanent magnets—the same or opposed direction of magnetization. Provided that the two magnet coils are energized in the same sense, there takes place a(n) (over)compensation or intensification of the permanent magnetic field, depending on the direction of the temporary magnetic field produced. It is also possible, however, to energize the two magnet coils alternately, a weakening or boosting of the permanent magnetic field taking place, depending on the formation of the temporary magnetic field produced.

The permanent magnets preferably have a sandwich structure, one or more plates of magnetic material, for example of neodymium-iron-boron, being embedded between two pole plates. It is also possible, however, to arrange one or more plates of magnetic material directly between individual component parts of the webs or between the baseplate and the webs. Also, for the alternative transport of non-ferromagnetic conveyed parts, for example aluminum plates, the webs may have suction bores for generating a negative pressure and for sucking the conveyed parts onto them. It goes without saying that in this connection suction bells at the top of the webs are also conceivable.

By activating one or more magnet coils, a duty cycle according to DIN of about 100% can be achieved. Altogether, a plurality of conveyed parts can be stacked or imbricated.

The two magnet coils consequently not only allow a compensation of the permanent magnetic field but also as it were on the one hand an overcompensation, i.e. repulsion, of the conveyed parts. On the other hand, the temporary magnetic field may be formed such that the permanent magnetic field is boosted. This is recommendable particularly in the case where individual conveyed parts are to be kept securely in stacks by means of the holding apparatus. That is to say, in this way it is possible to perform stack forming and removal operations. Of course, any intermediate stages between these two extremes are conceivable. They can be achieved by the two or more magnet coils being alternately energized. This generally takes place by the magnet coil arranged in the vicinity of the permanent magnets or in the vicinity of the working clearance generating a repelling effect, for example, while the magnet coil arranged in the region of the baseplate acts in a manner boosting the (permanent) field. At the same time, it is conceivable to achieve stacking or imbricating by utilizing the field boosting of the latter magnet coil. In any event, the independent energizing of the two or more magnet coils makes possible optimum adaptation to the conveyed parts to be transported. Irrespective of this, a coil may also be wound with a plurality of wires next to one another in order to realize the at least two mutually independently energizable magnet coils. It goes without saying that arranging the wires one above the other or one inside the other is also conceivable.

Depending on the weight and required adhesive force, one or both coils (or several coils) are activated, it being possible when energizing only one coil on the one hand for high switching frequencies to be produced. On the other hand, a plurality of conveyed parts can be unproblematically held securely in a stacking manner and released, to be precise by activating the second (or further) coils. It is always possible for the weakening or boosting forces and also the achievable switching frequencies to be adjusted adequately according to the intended application. What is more, the reduced self-induction effects avoid loads being exerted on the magnet coils, and furthermore high power levels are not required for their actuation. Accordingly, it is unlikely that the magnet coils will fail. These are to be regarded as the main advantages.

BRIEF DESCRIPTION OF THE DRAWINGS

The invention is explained in more detail below with reference to a drawing representing just one exemplary embodiment, in which.

DETAILED DESCRIPTION OF THE PREFERRED EMBODIMENT

Figure 2:
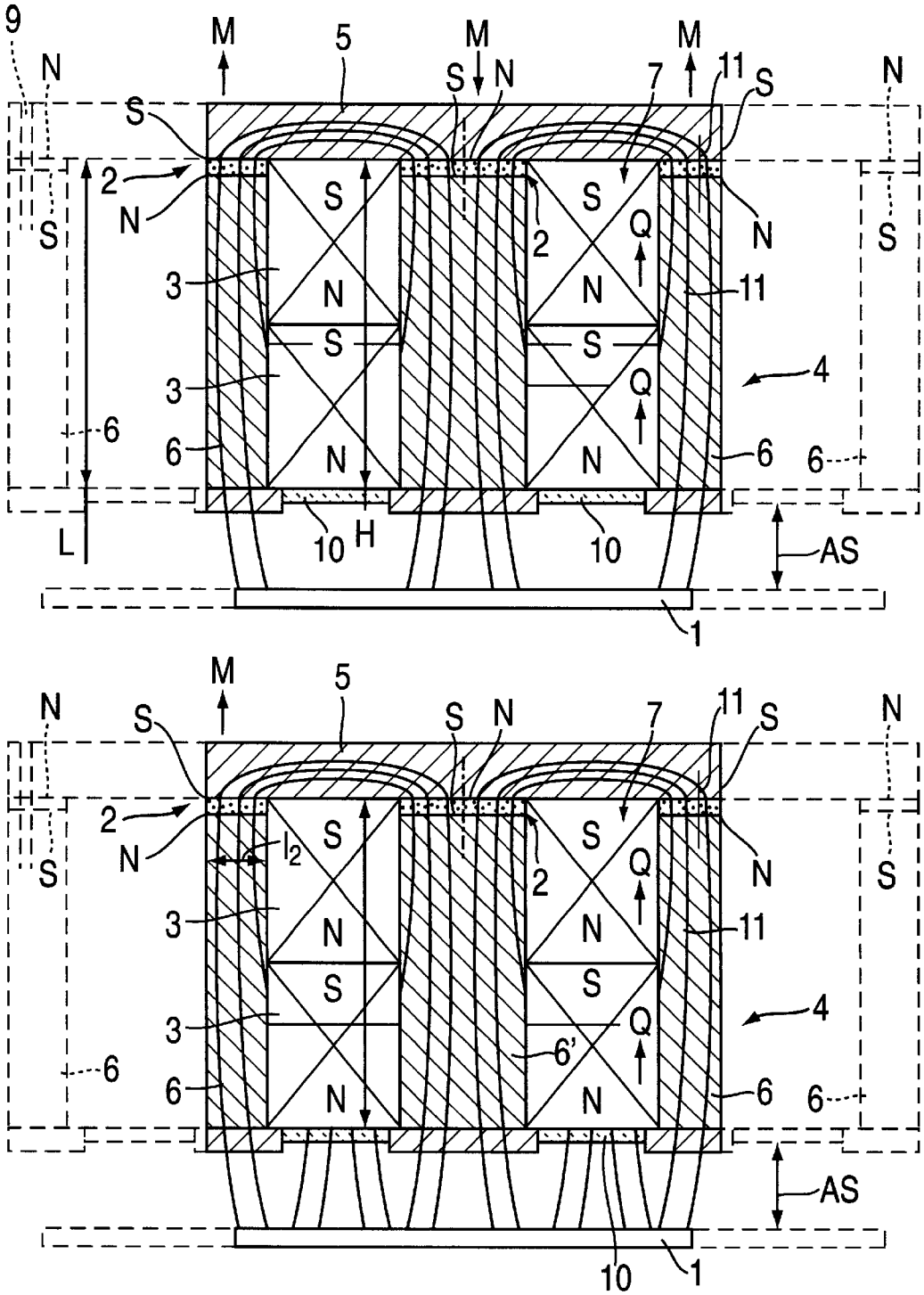
FIG. 2 shows a the subject according to FIG. 1, considering the field boosting scenario.
Figure 3:
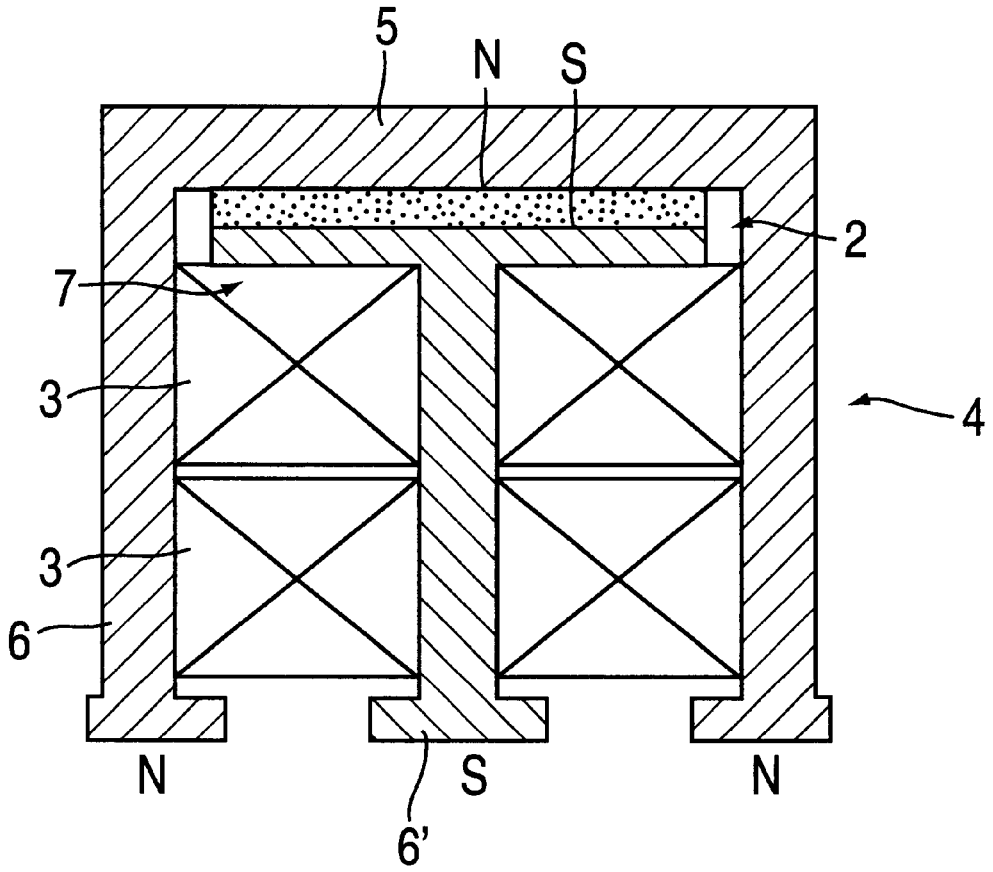
FIG. 3 shows a modified embodiment according to FIGS. 1 and 2 with a permanent magnet.

Shown in the figures is a holding apparatus for the transport of conveyed items, in particular for lifting, transporting, stacking and imbricating ferromagnetic conveyed parts 1. This apparatus has in its basic construction at least one permanent magnet 2 for generating a permanent magnetic field, also at least one electrical magnet coil 3 for generating a temporary magnetic field and compensation of the permanent magnetic field and a magnetically conductive housing 4. According to the exemplary embodiment in FIG. 1, three permanent magnets 2 are provided. In FIG. 3, one permanent magnet 2 is realized. Represented in FIG. 2 is an embodiment (dashed lines) according to which five permanent magnets 2 are provided.

The permanent magnets 2 are magnetized in each case in the direction of their smallest dimension $l_3$ and are arranged in the direction of magnetization M at the rear with one pole against the housing 4, forming a magnetic yoke, and at the front with the other pole in the direction of a working clearance AS opposite the conveyed parts 1. Like the working clearance AS, the direction of magnetization M is indicated by an arrow. The direction of magnetization is defined (in the customary way) by the direction of the arrow from the north pole (N) to the south pole (S). The permanent magnets 2 have a length $l_1$, a width $l_2$ and a height (or thickness) $l_3$ (smallest dimension). According to the exemplary embodiments, two electrical magnet coils 3 are provided.

It goes without saying that three or more magnet coils 3 may also be realized instead.

Figure 1:
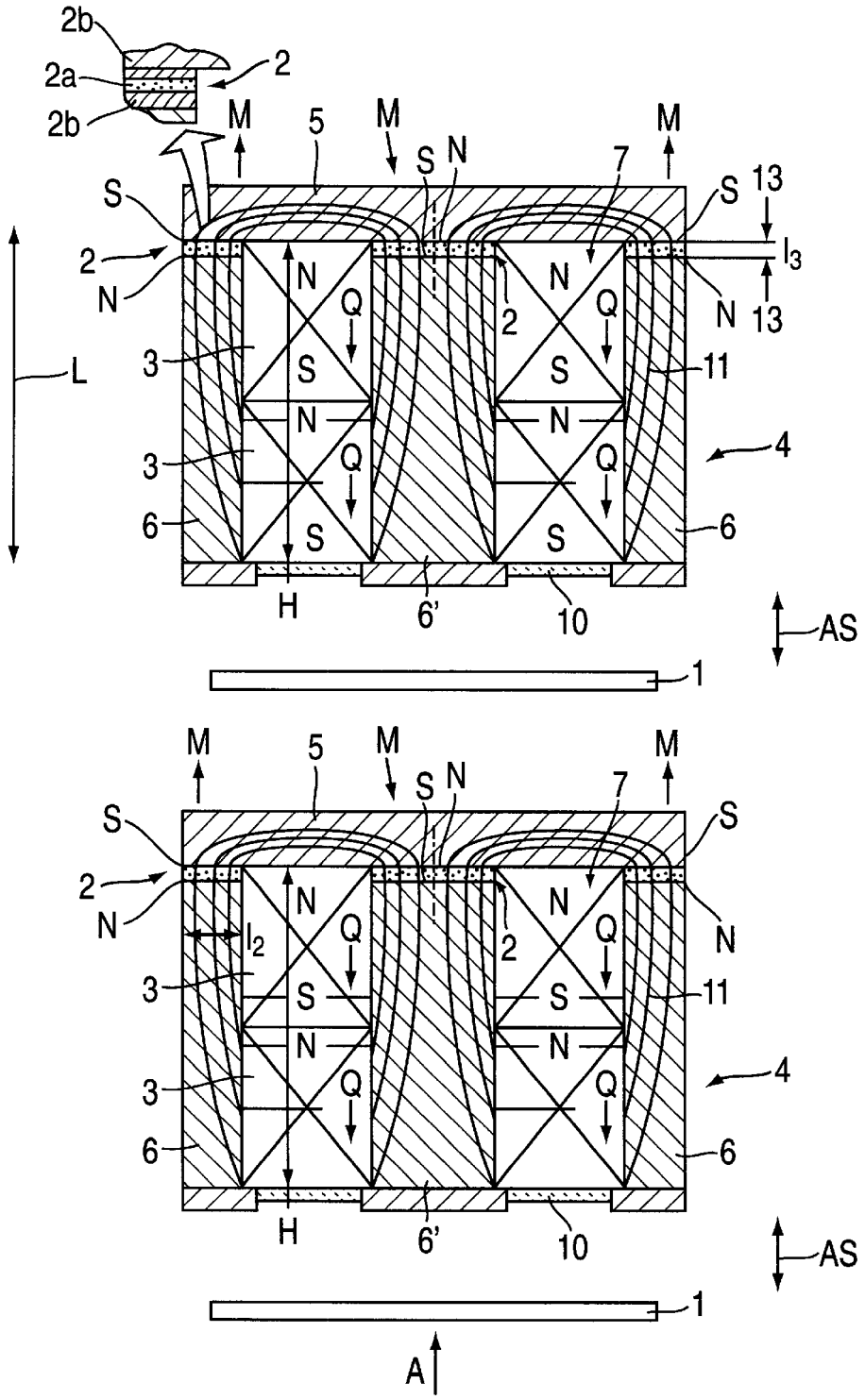
FIG. 1 shows a section through a holding apparatus according to the invention with field lines drawn in for the field weakening scenario.

As evidenced by FIG. 1, the housing 4 for the permanent magnets 2 and the magnet coils 3 has three webs 6—finger-like in cross section—which rise up from a baseplate 5 and have the permanent magnets 2. The permanent magnets 2 may be arranged at the bottom, at the top or in the longitudinal extent of the webs 6. Additionally provided are the at least two already mentioned magnet coils 3, which are energizable independently of one another. Furthermore, there is at least one inter-web space 7 for receiving the magnet coils 3. According to the exemplary embodiment in FIG. 1, two or three webs 6 are provided (cf. bottom and top of FIG. 4), with permanent magnets 2 in each case, which webs are arranged in cross section respectively lying opposite one another in pairs in comparison with a central middle web 6'. According to FIG. 2, there are three or five webs 6 (cf. bottom and top of FIG. 4), with permanent magnets 2 in each case, which webs are arranged in cross section respectively lying opposite one another in pairs in comparison with the central middle web 6'.

The number of webs 6 may also be greater and respectively assume a number corresponding to the rule: (n+1) webs 6 where n=1, 2, 3, . . . or (2n+1) webs 6 where n=1, 2, 3, . . .

The permanent magnets 2, fastened in the longitudinal extent of the webs 6, have—starting from the middle web 6'—respectively alternating directions of magnetization M. In this way, the webs 6, respectively lying opposite one another in pairs in comparison with the middle web 6', or the one web 6, appearing in cross section as a pair, have or has in each case permanent magnets 2 with the same direction of magnetization M. This can be seen in particular from FIG. 2. That is to say, as evidenced by the sectional representation in FIG. 2, pairs of permanent magnets 2 with the same direction of magnetization M are respectively formed and lie opposite one another—in comparison with the middle web 6'. Proceeding from the middle web 6' to the left or right in FIG. 2, the direction of magnetization M of the permanent magnets 2 respectively alternates in the way indicated.

The webs 6 rise up perpendicularly from the baseplate 5, the permanent magnets 2 being fastened in perpendicular prolongation of the webs 6 such that their respective direction of magnetization M coincides with the direction of the extent of the webs. Consequently, the direction of magnetization M of the permanent magnets 2 is also aligned perpendicularly in comparison with the baseplate 5. It should be emphasized that the exemplary embodiment represented of the holding apparatus is a so-called hanging design and the permanent magnets 2 can in principle be arranged in any desired position in comparison with the webs 6. That is to say, the holding apparatus shown is fastened such that it is hanging down from a frame, a toothed belt or the like and, by means of the permanent magnets 2, attracts conveyed parts 1 moved through the working clearance AS. These parts are securely held until a compensation of the permanent magnetic field takes place with the aid of the magnet coils 3, with the result that this permanent magnetic field is, as it were, forced out of the working clearance AS and the conveyed parts 1 fall down.

The webs 6 are arranged equidistantly in comparison with the middle web 6' and enclose between them equally sized spaces 7 between the webs. The baseplate 5 is generally of a circular design (cf. bottom of FIG. 4) and the webs 6 are arranged concentrically with respect to the cylindrical middle web 6', forming a rotationally symmetrical holding pot with spaces 7 between the webs in the form of annular channels. The baseplate 5 may, however, also be of a rectangular design (cf. top of FIG. 4), the webs 6 being arranged in the longitudinal direction mirror-symmetrically with respect to the in this case I-shaped middle web 6', forming a cuboidal holding bar with spaces 7 between the webs in the manner of longitudinal channels. This holding bar can be adapted unproblematically with regard to its geometrical dimensions to plates, boxes, etc., to be transported.

The two or more magnet coils 3 according to the exemplary embodiment are arranged in cross section in the direction of the extent of the webs with their turns 8 one behind the other or one above the other or else one inside the other in the spaces 7 between the webs, the respective turns 8 enclosing the middle web 6' concentrically in the manner of circles, ellipses or rounded-off rectangles. This can be seen particularly from the top and bottom of FIG. 4, where individual turns 8 are diagrammatically represented.

Figure 4:
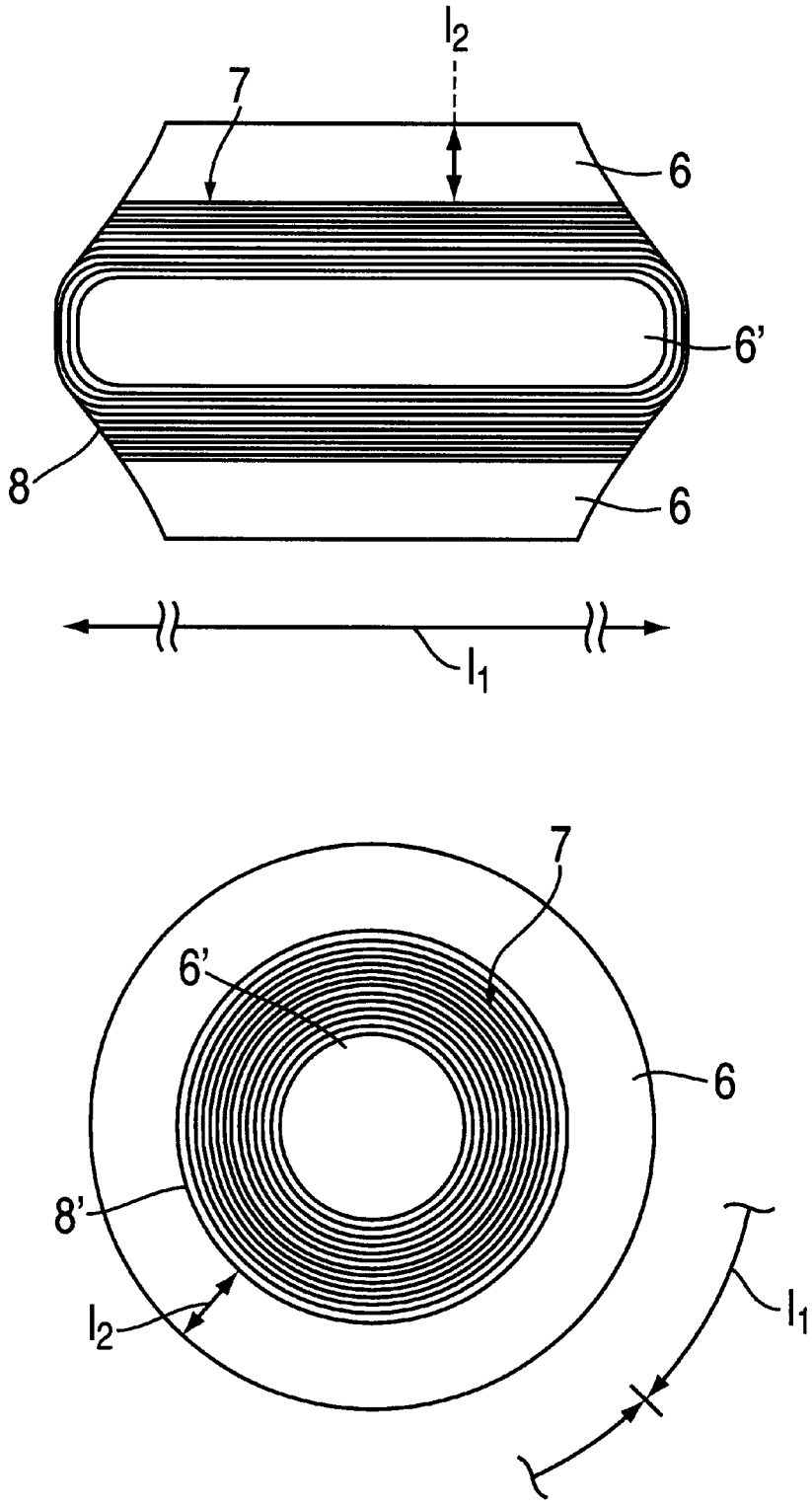
FIG. 4 shows a view in the direction of the arrow A in FIG. 1.

In the case of the rotationally symmetrical holding pot shown at the bottom of FIG. 4, a cylindrical middle web 6' is provided, the respective turns 8' enclosing this middle web concentrically in the manner of circles. Here there is only one inter-web space 7. According to the exemplary embodiment represented at the top of FIG. 4, two inter-web spaces 7 are provided. Here, the middle web 6' is of an I-shaped design and the turns 8 enclose this middle web 6' in the manner of ellipses or rounded-off rectangles.

The magnet coils 3 may be of the same or different designs with regard to their geometry and number of turns. What matters, however, is that they can always be energized with electrical power independently of one another. Their arrangement may be chosen such that they are placed one above the other or one behind the other. An arrangement one behind the other is conceivable in such a form that both magnet coils 3 have a common coil former and core for the turns 8. Arrangement one above the other is to be understood for the purposes of the invention as a configuration in which initially one coil is wound on a coil former with core and then the second coil is wound onto the first coil. In this way, temporary magnetic fields of the widest variety can be generated according to requirements and independently of one another, according to whether one, both or several magnet coils 3 are energized. It goes without saying that it is within the scope of the invention to use three or more magnet coils 3 if this appears to be necessary.

According to the exemplary embodiment, the two magnet coils 3 are arranged rising up from the baseplate 5 and have a combined overall height H which corresponds substantially to the length L of the webs 6. This is very clear from FIGS. 1 and 2. The temporary magnetic fields generated by the two magnet coils 3 are modeled on the field of a bar magnet with—in comparison with the direction of magnetization M of the permanent magnets 2—the same or opposing direction of magnetization Q. This follows from FIGS. 1 and 2, in which the substitute bar magnet is indicated by corresponding designation of the poles produced (N=north pole; S=south pole). Also depicted in these figures is the corresponding direction of magnetization Q, which in comparison with the direction of magnetization M of the permanent magnets has a direction which is the same or opposing.

If the two magnet coils 3 are energized in the same sense, a(n) (over)compensation or boosting of the permanent magnetic field takes place, depending on the direction of the temporary magnetic field produced. The two magnet coils 3 can, however, also be energized alternately, a weakening or boosting of the permanent magnetic field taking place, depending on the formation of the temporary magnetic field produced. These individual scenarios are shown in FIG. 1 for the case of field weakening or compensation and in FIG. 2 for the alternative, field boosting or intensification. This is discussed in more detail below.

The permanent magnets 2 have a sandwich structure, a plate of magnetic material 2*a,* for example of neodymium-iron-boron, being embedded between two pole plates 2*b*. The entire sandwich structure, and consequently the permanent magnet 2, may be screwed onto the housing 5, according to requirements. In this way, the permanent magnets 2 can be prefabricated. In FIG. 2 it is indicated that, for the alternative transport of non-ferromagnetic conveyed parts 1, for example aluminum plates, the webs 6 may have suction bores 9 for generating a negative pressure and for sucking the conveyed parts 1 onto them. In this way, the holding apparatus according to the invention can be used for aluminum transport in vacuum combination installations. The fact that the permanent magnetic field generated by the permanent magnets 2 can be fully compensated by means of the magnet coils 3 means that eddy currents in the transported aluminum are reliably avoided. Effects of the aluminum warming or heating up occur just as little as eddy current losses.

In FIG. 1, the field lines of the permanent magnetic field (bold) and of the temporary magnetic field (normal line thickness) are represented. The energizing of the two magnet coils 3 is chosen such that overall a weakening of the permanent magnetic field is to be observed. In this case, a conveyed part 1 which originally is securely held is let go. Represented in FIG. 2 is the scenario in which a boosting or intensifying of the permanent magnetic field takes place. This is suitable for the case where not only one conveyed part 1, but for example a stack of conveyed parts 1 is to be securely held. It goes without saying that graduations between the two extremes represented are possible by only individual magnet coils 3 being energized. In this case, low inductances are to be expected, with the result that high switching frequencies are achieved. A reliable compensation of the permanent magnetic field can be achieved if both magnet coils 3 are actuated by electrical power. The overall effect is to achieve with low energy expenditure for the magnet coils 3—if desired—an extremely high switching capability as well a sustained compensation (up to 100% duty cycle) of the permanent magnetic field, for example during the transport of aluminum conveyed parts 1.

From a structural design viewpoint, it should be pointed out that the housing 4, or the baseplate 5 and the webs 6, is overall a flat-steel welded housing which is simple to produce. The magnet coils 3 are sealed with respect to the working clearance AS by a coil casting compound 10. The permanent magnets 2 are held in the webs 6 by means of screws 11. The overall resistance of the two magnet coils 3 (series connection) is about 50 ohms. The magnet coils 3 have in each case about 1000 turns 8 of a wire with a cross section of 0.5 $mm^2$. With an applied voltage of 100 volts, a current of about 2 amperes is obtained. This results in a current density of approximately 4 amperes/$mm^2$. The achievable magnetic field strength (symbol H) is about 2000 amperes/m (calculated for a solenoid on the basis of the formula H=n I/L where n=the number of coil turns; L=length of the coil and I=current intensity). Switching frequencies of over 120 switchings/min can be achieved, the switch-over time being less than about 250 msec. The width of the housing 4 is 100 mm, two overall lengths, namely 250 mm and 500 mm, generally being adopted in the case of a cuboidal holding bar. The switching frequency quoted can be achieved at a duty cycle according to DIN of about 40% (over 10 min) and use of a magnet coil 3. If the further magnet coil 3 is activated, a compensation time or duty cycle of about 100% is accomplished. The percentage quoted here relates to a time prescribed by DIN of 10 min, which must be completed without the magnet coils 3 burning out.

While the preferred embodiment of the invention has been depicted in detail, modifications and adaptations may be made thereto, without departing from the spirit and scope of the invention, as deliniated in the following claims:

What is claimed is:

1. A holding apparatus for the transport of conveyable articles, particularly for the lifting, transportation and stacking of ferromagnetic conveying articles, said apparatus comprising:

at least two permanent magnets for generating a permanent magnetic field, wherein the permanent magnets are arranged in the web in each case at the bottom, top or in a position in between;

at least two electric magnet coils, capable of being acted upon independently of one another either alternately or in the same direction, for generating a temporary magnetic field and for compensating for or intensifying the permanent magnetic field, and a magnetically conductive housing having two webs extending from a base plate, wherein, in each web at least one permanent magnet is capable of being screwed on, wherein the permanent magnets in each case are arranged:

in a magnetizing direction (M), at the rear, wherein on pole (N, S)

on the housing forms a magnetic return, and at the front, with the other pole (S, N) in the direction of a working gap (AS) relative to the conveyable articles;

wherein the extension of the webs coincide with the respective magnetizing direction (M) of the permanent magnets; and wherein the magnetic coils are arranged, in cross section, in the direction of the web extension, with their windings, one behind the other or one above the other, in at least one web interspace, so as to rise on the base plate; and having a combined overall height which corresponds essentially to the length (L) of the webs; and wherein there are (2n+1) or (n+1) webs (6), where n=1, 2, 3, permanent magnets in each case, wherein the webs are arranged in cross section lying respectively opposite one another in pairs in comparison with a central middle web.

2. The holding apparatus of claim 1, wherein the permanent magnets fastened in the longitudinal extent of the webs have, starting from the middle webs, respectively alternating directions of magnetization.

3. The holding apparatus of claim 2, wherein the webs rise up perpendicularly from the baseplate, and wherein the permanent magnets are fastened in perpendicular prolongation of the webs such that their respective direction of magnetization (M) coincides with the direction of the extent of the web.

4. The holding apparatus of claim 3, wherein the webs are arranged equidistantly in comparison with the middle web and enclose between them equally sized inter-web spaces.

5. The holding apparatus of claim 4, wherein the base plate is of a circular design and the webs are arranged concentrically with respect to the cylindrical middle web, forming a rotationally symmetrical holding pot with inter-web spaces in the form of annular channels.

6. The holding apparatus of claim 4, wherein the baseplate is of a rectangular design and the webs are arranged mirror-symmetrically in the longitudinal direction with respect to the middle web, wherein the middle web is I-shaped, said web forming a cuboidal holding bar with inter-web spaces in the manner of longitudinal channels.

7. The holding apparatus of claim 6, further comprising suction bores for the transport of non-ferromagnetic conveyed parts, for example aluminum plates, wherein the suction bores generate a negative pressure and for sucking the conveyed parts onto them.

8. The holding apparatus of claim 7, wherein the two magnet coils are arranged in cross section in the direction of the extent of the webs wherein their turns are one behind the other or one above the other in the inter-web space, wherein the respective turns enclose the middle web concentrically in the manner of circles, ellipses, rounded-off rectangles or the like.

9. The holding apparatus of claim 8, wherein the two magnet coils are arranged rising up from the baseplate and have a combined overall height (H) which corresponds substantially to the length (L) of the webs.

10. The holding apparatus of claim 9, wherein the temporary magnetic fields generated by the two magnet coils are modeled on the field of a bar magnet with—in comparison with the direction of magnetization (M) of the permanent magnets—the same or opposing direction of magnetization (Q).

11. The holding apparatus of claim 10, wherein the two magnet coils are energized in the same sense, wherein the permanent magnetic field taking place is compensated for or boasted, depending on the direction of the temporary magnetic field produced.

12. The holding apparatus of claim 11, wherein the two magnet coils are energized alternately, a weakening or boosting of the permanent magnetic field taking place, depending on the formation of the temporary magnetic field produced.

13. The holding apparatus of claim 12, wherein the permanent magnets have a sandwich structure, one or more plates of magnetic material, for example of neodymium-iron-boron, being embedded between two pole plates.

14. The holding apparatus of claim 13, wherein, by activating one or more magnet coils, a duty cycle of about 100% is achieved.

15. The holding apparatus of claim 14, wherein a plurality of conveyed articles can be stacked or imbricated.

* * * * *